US005971233A

United States Patent [19]

Weber

[11] Patent Number: 5,971,233

[45] **Date of Patent: *Oct. 26, 1999**

[54] METHOD AND APPARATUS FOR PLACING REFRACTORY SAND IN THE DISCHARGE CHANNEL OF A METALLURGICAL VESSEL

[76] Inventor: Juergen Weber, c/o 5 Strattonville Crescent, Uxbridge, Ontario, Canada, L9P 1R4

[ * ] Notice: This patent issued on a continued prosecution application filed under 37 CFR 1.53(d), and is subject to the twenty year patent term provisions of 35 U.S.C. 154(a)(2).

[21] Appl. No.: 08/764,845

[22] Filed: Dec. 13, 1996

[30] Foreign Application Priority Data

May 8, 1996 [CA] Canada ..... 2176096

[51] Int. Cl.[6] ..... B22D 41/08

[52] U.S. Cl. ..... 222/597; 266/272

[58] Field of Search ..... 222/590, 591, 222/597, 600; 266/45, 271, 272

[56] References Cited

U.S. PATENT DOCUMENTS 4,795,066 1/1989 Worrell ..... 222/590

FOREIGN PATENT DOCUMENTS 0132364 8/1983 Japan ..... 222/600
1581058 12/1980 United Kingdom ..... 222/600
8001659 8/1980 WIPO ..... 222/600

*Primary Examiner*—Scott Kastler
*Attorney, Agent, or Firm*—John M. Harrington; Kilpatrick Stockton LLP

[57] ABSTRACT

A method of placing a quantity of refractory sand in the discharge channel of a bottom discharging metallurgical vessel includes the steps of orienting the vessel whereby the channel is presented in a horizontal direction, and opening the channel. A generally cylindrical cartridge of refractory sand, closed at both ends, is then loaded onto a casing dimensioned to slide into the discharge channel. The casing with its cartridge of sand is then slid into the channel, the channel is closed and the vessel is righted.

4 Claims, 1 Drawing Sheet

METHOD AND APPARATUS FOR PLACING REFRACTORY SAND IN THE DISCHARGE CHANNEL OF A METALLURGICAL VESSEL

The present invention relates to the field of metallurgical equipment, and in particular, to a method and apparatus for introducing refractory sand into the discharge channel of a vessel, especially a steel making ladle.

It is known to use refractory sand to fill the discharge channel of a bottom slide ladle. This prevents molten steel or other metal from solidifying in the discharge channel before a tap, a condition that makes it necessary to use an oxygen lance to open the slide. This is a dangerous and time consuming operation.

The ambient temperature in and over a ladle during steelmaking operations is typically in the range of 1200° C.–1700° C. Therefore, it has heretofore been difficult to place sand in the discharge channel of a ladle. This has conventionally been done with the ladle upright, and the slide closed to prevent the sand from escaping through the channel. Then, one of three conventional methods has been attempted. Often, bags of sand are tossed into the ladle at the channel. This is wasteful, and does not assure that the slide will be covered. Alternatively, a hopper can be lowered to a position near the channel, and sand then released. However, manoeuvring of the hopper is difficult in the high ambient temperatures, and the operation is time consuming. Lastly, a funnel can be used to deliver sand from near the lip of the ladle to the channel. Again, this is a hazardous operation in the high ambient heat, and it is time consuming.

One object of the present invention is to provide a method of sanding the discharge channel of a metallurgical vessel, during conditions of high heat.

Another object of the present invention is to provide a cartridge containing refractory sand for insertion into the discharge channel of a metallurgical vessel.

In a broad aspect, the present invention relates to a method of placing a quantity of refractory sand in the discharge channel of a bottom discharging metallurgical vessel, including the steps of: orienting said vessel whereby said channel is presented in a horizontal direction, and opening said channel; loading a generally cylindrical cartridge of refractory sand, closed at both ends, onto a casing dimensioned to slide into said discharge channel; sliding said casing with its cartridge of sand, into said channel, closing said channel, and righting said vessel.

In another broad aspect, the present invention relates to a cartridge for emplacement in the discharge channel of a metallurgical vessel having a bottom discharge, including: a cylindrical bag of refractory sand; a casing dimensioned to fit fairly snugly within said discharge channel, for loading said bag of sand into said channel.

In drawings that illustrate the present invention by way of example:

Figure 1A:
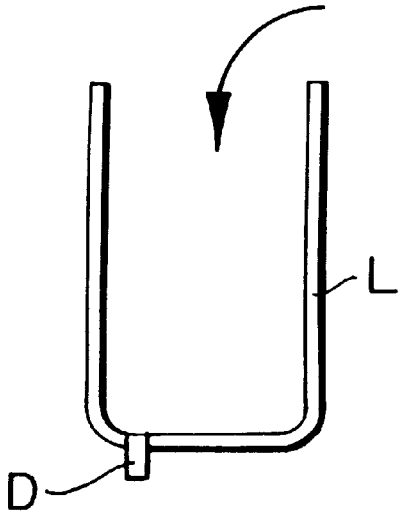
FIG. 1A PRIOR ART
FIGS. 1A and 1B are, respectively, diagrammatic representations of the prior art methods of sanding the opening channel of a metallurgical vessel, and the method of the present invention.
Figure 1B:
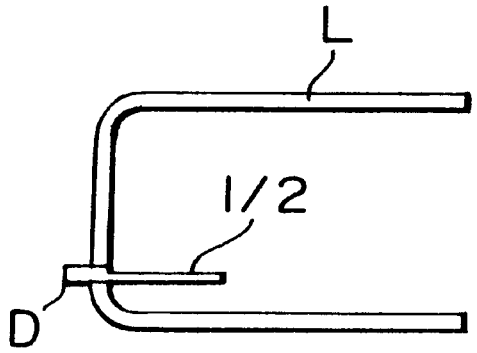

Referring now to FIGS. 1A and 1B, it will be observed that according to prior methods, the discharge channel D of a metallurgical vessel or ladle L is sanded from above, as indicated by the arrow. The ladle L has traditionally been sanded in the upright position, there having been no practical method of sanding the channel with the ladle oriented otherwise. The problem, however, with sanding from above, either with bags, a hopper, or a funnel, is that the extreme heat from the ladle prevents efficient work from being carried out in the space directly above the ladle. The methods diagrammatically represented by FIG. 1A tend, therefore, to be inefficient, time consuming and dangerous.

According to the present invention, however, the ladle is laid on its side to have its discharge channel sanded, as presented by FIG. 1B. It will be appreciated that a person can approach the open discharge channel D of the ladle L and efficiently insert a pre-measured cartridge, according to the present invention. This operation is both safe and quick. In this regard it will be understood that the ladle can be tilted onto its side with no difficulty, using the equipment currently in use in steel mills and the like.

Figure 2:
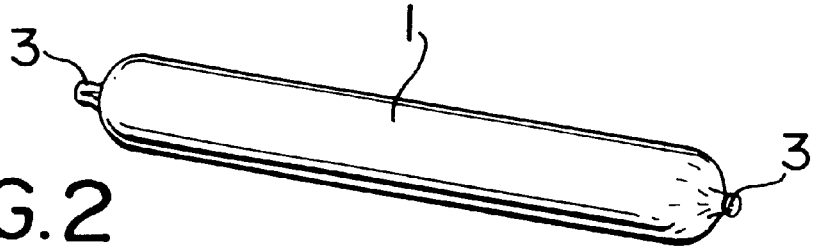
FIG. 2 is a perspective view of a sand cartridge of the present invention.
Figure 3:
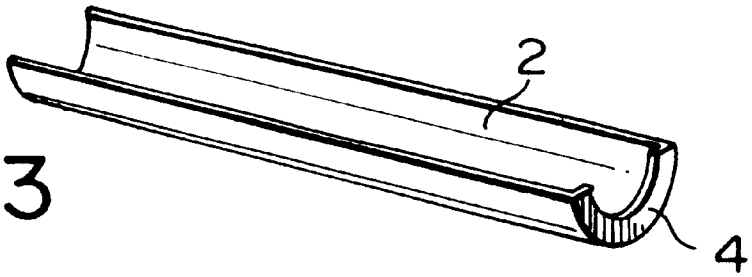
FIG. 3 is a perspective view of an insertion casing according to the present invention.

In order to permit a sanding operation to be conducted safely, according to the method of the present invention, there is provided a refractory sand cartridge 1 (see FIG. 2) and an insertion casing 2 (see FIG. 3). The sand cartridge 1 is a diameter selected to slide easily into the discharge channel of a metallurgical vessel, but to fit fairly snugly therein. It is made from a flexible plastic tube, sealed or fastened closed at each end 3, and filled with refractory sand. The selection of a suitable refractory sand will be an obvious matter of choice for one skilled in the art to which the present invention pertains. However, an example of a suitable formation for an acceptable refractory sand is as follows:

| | |
|---|---|
| $Cr_2O_3$ | 31–35% |
| $Al_2O_3$ | 9.5–11.5% |
| $SiO_2$ | 26–30% |
| $Fe_2O_3$ | 18–22% |
| CaO | 0.1–0.2% |
| MgO | 5.5–7.5% |
| $K_2O$ | 0.2–0.3% |
| $Na_2O$ | 0.2–0.3% |
| C | 0.4–0.6% |

For such a sand, a grain size of 0.1 to 1.5 mm, and a density of 2.05–2.15 kg/dm$^3$ are appropriate.

Figure 4:
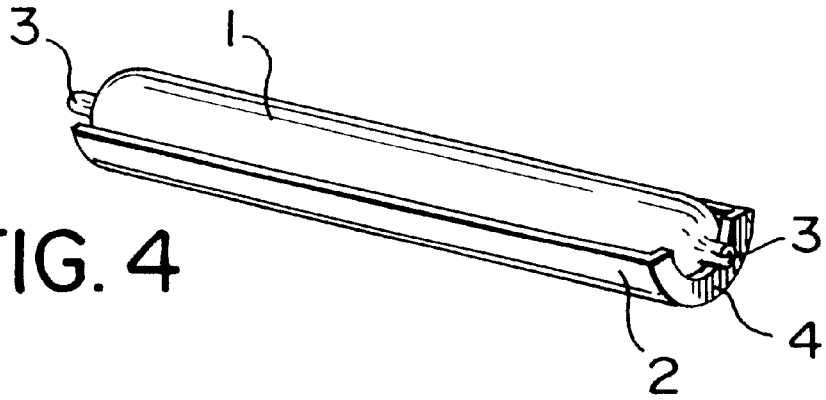
FIG. 4 is a perspective view of a sand cartridge loaded onto an insertion casing, for insertion into the discharge channel of a metallurgical vessel.

In order to insert the sand cartridge into the discharge channel of a hot ladle smoothly, the present invention provides an insertion casing 2 (see FIGS. 3 and 4). The casing is formed preferably as a longitudinal semi-cylindrical shell, one end of which is provided with an inwardly directed lip or flange 4. The shell holds a cartridge 1 of sand, and can be slid easily into an open discharge channel. The lip 4 prevents the cartridge from slipping during the insertion procedure, which is conducted in conditions of very high ambient temperature. The casing 2 is made from thin sheet steel, which will melt on contact with molten steel, into the steel. The refractory sand, on contact with molten steel, will solidify into a plug, to isolate the ladle slide from the molten steel. The ladle slide may then be opened when desired, and the steel will then flush out the plug, and flow out through the discharge channel. When a pour is thus complete, the ladle will be laid on its side, and a new cartridge inserted in the discharge channel to again protect the slide from molten steel.

It will be understood that the casing 2, which is illustrated as a semi-cylindrical shell, may extend over a greater extend of a cylinder, and may be a full cylinder, if desired. The end of the casing 2 may be more closed than provided for by flange 4, but the invention will function quite well if no flange 4 at all is provided.

It is to be understood that the examples described above are not meant to limit the scope of the present invention. It is expected that numerous variants will be obvious to the person skilled in the field of the present invention without any departure from the spirit of the invention. The appended claims, properly construed, form the only limitation upon the scope of the invention.

I claim:

1. A cartridge for emplacement in the discharge channel of a metallurgical vessel having a bottom discharge, including:

(a) a cylindrical bag of refractory sand;

(b) a casing dimensioned to fit fairly snugly within said discharge channel, for loading said bag of sand into said channel;

wherein at least one end of said casing is provided with a radially inwardly directed flange.

2. A cartridge as claimed in claim 1, wherein said casing is generally semi-cylindrical.

3. A cartridge as claimed in any one of claim 1, wherein said bag is a plastic bag, sealed or secured at each end.

4. A cartridge as claimed in claim 1, wherein said refractory sand has a grain size of 0.1 to 1.5 mm, and has approximately the following composition:

| | |
|---|---|
| $Cr_2O_3$ | 31–35% |
| $Al_2O_3$ | 9.5–11.5% |
| $SiO_2$ | 26–30% |
| $Fe_2O_3$ | 18–22% |
| CaO | 0.1–0.2% |
| MgO | 5.5–7.5% |
| $K_2O$ | 0.2–0.3% |
| $Na_2O$ | 0.2–0.3% |
| C | 0.4–0.6%. |

* * * * *